US005344074A

United States Patent [19]

Spriggs et al.

[11] Patent Number: 5,344,074

[45] Date of Patent: Sep. 6, 1994

[54] DISPENSING APPARATUS HAVING A REMOVABLE VARIABLE PROPORTIONING AND METERING DEVICE

[75] Inventors: John R. Spriggs, Minneapolis; James D. Decker; James L. Copeland, both of Apple Valley; Spencer B. Larson, Lilydale, all of Minn.

[73] Assignee: Ecolab Inc., St. Paul, Minn.

[21] Appl. No.: 16,776

[22] Filed: Feb. 11, 1993

Related U.S. Application Data

[63] Continuation-in-part of Ser. No. 765,576, Sep. 25, 1991, abandoned.

[51] Int. Cl.[5] ..... B05B 7/04; B05B 7/30

[52] U.S. Cl. ..... 239/10; 239/71; 239/305; 239/307; 239/318; 239/408; 239/417.5; 239/526; 239/570; 239/600; 137/614; 137/893

[58] Field of Search ..... 239/10, 71, 303, 304, 239/305, 307, 310, 318, 408, 417.5, 434, 412, 526, 570, 571, 600; 222/74, 145; 137/614, 893; 251/149.8

[56] References Cited

U.S. PATENT DOCUMENTS

| | | | |
|---|---|---|---|
| 1,610,714 | 12/1926 | Smith | 239/318 |
| 2,054,136 | 9/1936 | Pfaff et al. . | |
| 2,716,507 | 8/1955 | Graves | 239/526 |
| 2,811,389 | 10/1957 | Fischer . | |
| 2,993,651 | 7/1961 | Packard | 239/318 |
| 3,037,707 | 6/1962 | Ligon | 239/310 |
| 3,168,967 | 2/1965 | Giampa . | |
| 3,303,800 | 2/1967 | Young . | |
| 3,430,865 | 3/1969 | McDougall | 239/434 X |
| 3,650,479 | 3/1972 | Liedberg | 239/600 X |
| 3,675,851 | 7/1972 | Merfeld et al. | 239/318 |
| 3,811,618 | 5/1974 | Gartner et al. | 239/312 |
| 3,863,843 | 2/1975 | Hechler, IV | 239/318 |
| 4,142,681 | 3/1979 | Hechler, IV | 239/318 |
| 4,238,074 | 12/1980 | Coons | 239/310 |
| 4,247,046 | 1/1981 | Hechler, IV | 239/318 |
| 4,254,805 | 3/1981 | Reeder . | |
| 4,327,770 | 5/1982 | Brown et al. | 251/149.8 X |
| 4,505,431 | 3/1985 | Huffman | 239/434 X |
| 4,527,740 | 7/1985 | Gunzel, Jr. et al. | 239/318 |
| 4,697,610 | 10/1987 | Bricker et al. | 239/318 |
| 4,717,077 | 1/1988 | Takata | 239/600 X |
| 4,750,645 | 6/1988 | Wilson et al. | 222/145 |
| 4,753,370 | 6/1988 | Rudick . | |
| 4,901,923 | 2/1990 | McRoskey et al. | 239/310 |
| 4,928,853 | 5/1990 | Isham et al. . | |
| 4,947,739 | 8/1990 | Owen . | |
| 4,991,821 | 2/1991 | Beaston | 251/149.8 |
| 5,033,649 | 7/1991 | Copeland et al. . | |
| 5,037,003 | 8/1991 | Bally et al. . | |
| 5,042,523 | 8/1991 | Robertson et al. . | |
| 5,060,825 | 10/1991 | Palmer et al. . | |
| 5,074,438 | 12/1991 | Ingram . | |
| 5,253,807 | 10/1993 | Newbegin | 239/600 |
| 5,255,820 | 10/1993 | Thomas | 222/1 |
| 5,259,557 | 11/1993 | Spriggs et al. | 222/145 |

FOREIGN PATENT DOCUMENTS 0325335 7/1989 European Pat. Off. .

(List continued on next page.)

OTHER PUBLICATIONS

Hydro Systems Company: HydroSprayer Series, "Liquid Proportioners"; ©1989.

(List continued on next page.)

*Primary Examiner*—William Grant

*Attorney, Agent, or Firm*—Merchant, Gould, Smith, Edell, Welter & Schmidt

[57] ABSTRACT

A system for diluting and dispensing concentrated liquid products is disclosed. The system includes a dispensing device (10, 150) containing a removable proportioning means such as an aspirator assembly (40, 154). A concentrate pickup tube (114) attaches to the dispensing device and is in fluid communication with the aspirator assembly. The dispensing device can utilize a rigid outlet tube (20, 159) which is removably attached to nozzle tip (18, 158) for dispensing to large containers. Also disclosed is a method for diluting and dispensing chemical solutions using the dispensing device of the invention.

32 Claims, 10 Drawing Sheets

FOREIGN PATENT DOCUMENTS

| | | |
|---|---|---|
| 2150427 | 8/1973 | Fed. Rep. of Germany . |
| 1139021 | 6/1957 | France . |
| 780202 | 7/1957 | United Kingdom . |
| 2010105 | 11/1978 | United Kingdom . |
| WO85/05092 | 11/1985 | World Int. Prop. O. . |
| WO89/09361 | 10/1989 | World Int. Prop. O. . |

OTHER PUBLICATIONS

Hydro Systems Company: New Product Development: Multiple Product Selector Valve.

Hydro Systems Company: New Product Development: Variable Dilution Selector Valve.

Hydro Systems Company: HydroFoamer Series, "Automatic Foaming Hose End Liquid Proportioner", ©1988.

Economics Laboratory, Inc. Control Tower II Advertising Brochure No. 13554/0402/0783.

Dema Engineering Company Blend Center Brochure Bulletin No. 87003.

Dema Engineering Company Multi-Blend Center Brochure Bulletin No. 89010.

Dema Engineering Company Drum-Mount Proportioner Model 162 Brochure No. 84002.

Dema Engineering Company Demamatic Liquid Level Proportioning Controls Bulletin No. 83009.

Dema Engineering Company New Magnetically Operated Demamatic Liquid Level Bulletin No. 87-012.

Ecolab Sani-Center Installation and Operation Manual ©1989.

Ecolab Inc., "Cleaning Help Available" Brochure, ©1991.

Ecolab OASIS Installation and Operation Manual, ©1990.

FIG.12
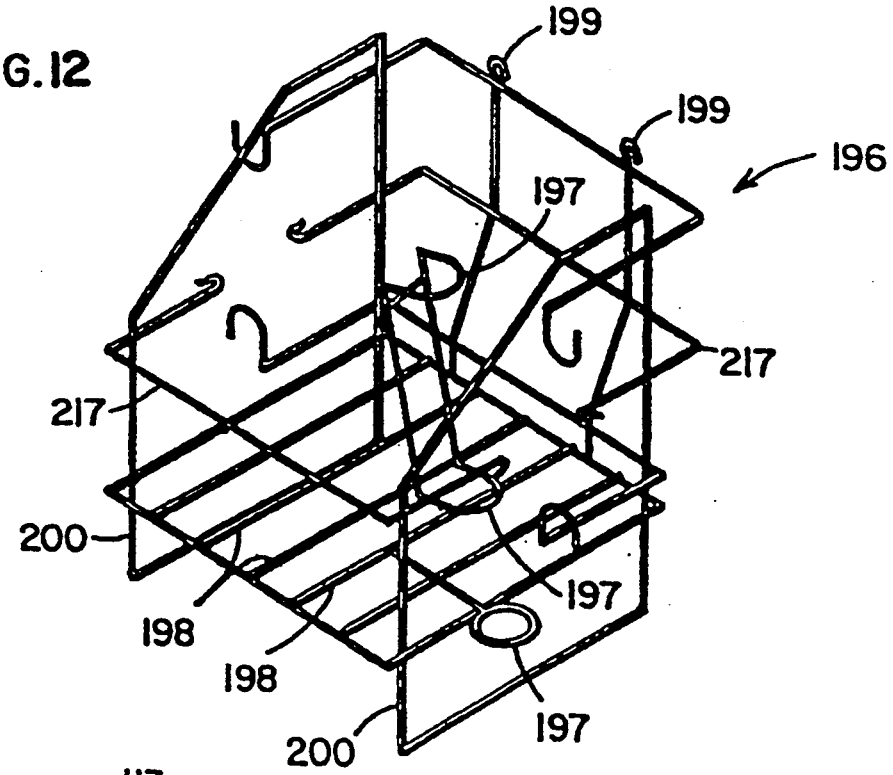
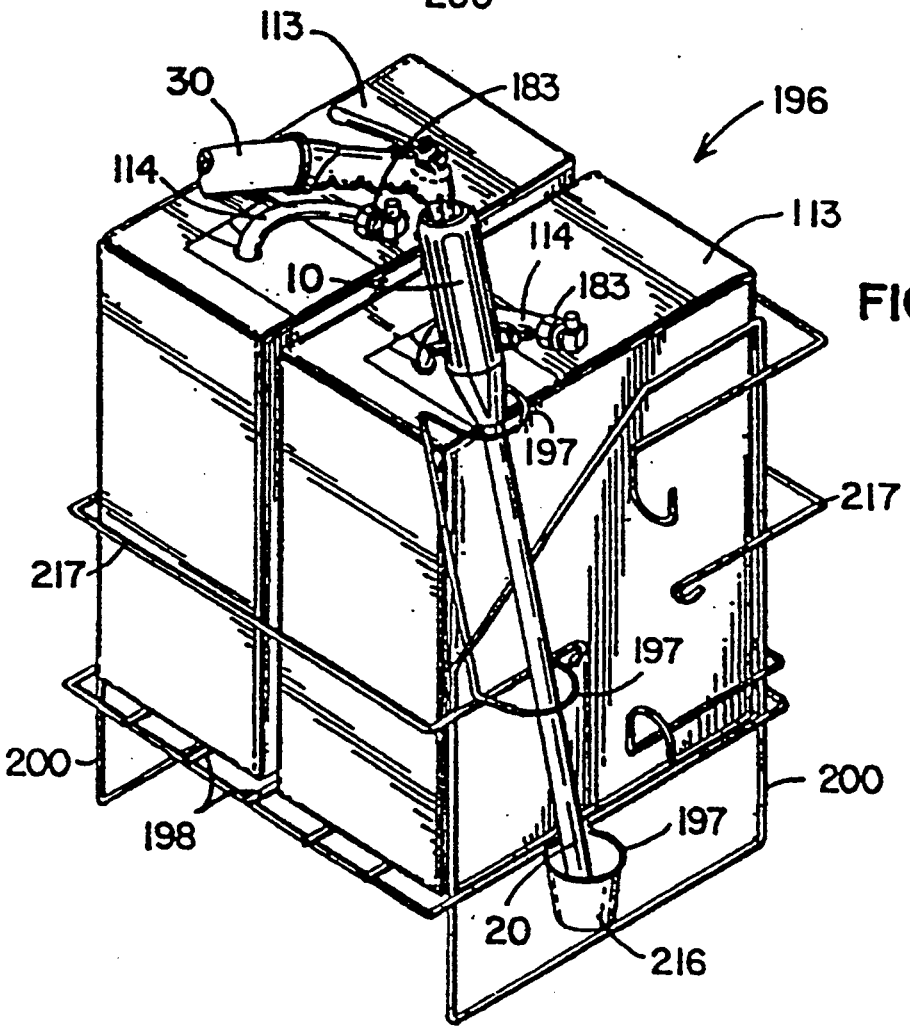
FIG.13

DISPENSING APPARATUS HAVING A REMOVABLE VARIABLE PROPORTIONING AND METERING DEVICE

This patent application is a continuation-in-part of U.S. Ser. No. 07/765,576 filed Sep. 25, 1991, now U.S. Pat. No. 5,259,557, issued Nov. 9, 1993.

FIELD OF THE INVENTION

The present invention relates generally to a system for diluting concentrated liquid products and for dispensing the mixed solution, and more particularly to a dispensing apparatus which employs a removable variable proportioning and metering device to proportionally mix a concentrated liquid chemical with water.

BACKGROUND OF THE INVENTION

In janitorial settings which require a significant amount and number of specialized cleaning solutions, the liquid cleaning products are purchased on a concentrated basis, and then are diluted to the proper strength at the site where they will be used. This type of general system is employed by a wide variety of users, e.g., hotels, hospitals, restaurants, etc. Several dispensing systems have been developed for mixing and diluting the concentrated cleaning product. The dispensers usually feature at least some of the following components: a container for the concentrated cleaning product, a storage container for the diluted cleaning product, a method to dose concentrate into the storage container, and a water supply line to dilute the concentrate.

The dispensing systems vary widely in terms of their complexity. The method of dilution may be rather simple and manual in nature, but may require a great deal of operator experience. On the other hand, the dispensing system may be quite complex, requiring several mechanical devices to dilute the concentrates. Such complex systems are often necessary where different cleaning products and different dilution ratios are utilized for different cleaning applications. These dispensing systems typically require several separate water lines, each water line corresponding to a different type of cleaning concentrate. The provision of multiple water lines increases the cost of installation, greatly limits the locations at which the dispensing system can be placed, and such a system is not portable. Accordingly, large containers such as mop buckets and auto scrubbers must be filled and taken to the point of usage by the janitorial personnel.

With one such system, a cabinet is mounted proximate the concentrated liquids and the water source. This cabinet contains a multiplicity of aspirators, backflow preventers and valves for dilution of the concentrates, the number of such devices depending upon the predetermined number established by the cabinet's manufacturer. However, such a system can be relatively complex, inflexible and expensive, especially in situations where only one concentrated liquid is utilized.

The cost of these conventional dispensing stations is relatively high, because of their complexity and because backflow preventers are generally required for each water connection by applicable plumbing codes. Pressure regulators may also be necessary to control use solution concentrations within an acceptable range. Other necessary flow control devices add to the cost of conventional dispensing systems. For example, a pickup probe and foot valve must be employed in order to withdraw the concentrate from a rigid container.

An aspirator is employed with some dispensing systems to withdraw the concentrated cleaning solution from its container. With conventional systems, each water line requires a separate aspirator, and the aspirators are located in a variety of places, such as mounted to the concentrate container or mounted upon the wall adjacent to the dispensing station. These locations of the aspirator add to the complexity and space requirements of the dispensing system. Other aspirators have been constructed that require changing the nozzle throat by removing the primary flow plumbing and forcing the nozzle component out and inserting a different nozzle and then reassembling the primary flow plumbing. Prior aspirators have also accommodated different flow requirements by offering various sized aspirator assemblies, which necessitated additional tooling, inventory and provided inflexibility after an installation had been made. Prior aspirators also used a fixed diameter nozzle to attain average results based on average conditions. Other aspirators do have a means to use different sized nozzles, but require the aspirator to be disassembled.

A number of prior systems use aspirators to form use solutions from concentrated chemicals. In one system, an aspirator that is permanently attached to a use solution reservoir is utilized. The spray gun is then attached to the aspirator to fill the use solution reservoir. In another system, an aspirator is employed that is permanently assembled to the spray gun. The assembly is then attached to the use solution reservoir or inserted into a bucket or other container to fill with use solution. With this system, the primary flow is fixed. In other systems, aspirators are used which are permanently fixed to a wall or equipment. To change the use solution concentration requires that concentrate pickup tubing be detached from the aspirator, the metering orifice be changed and the tubing replaced. No provision is made to modify the primary flow.

Another area in which liquid aspirators are commonly employed is the application of diluted solutions to lawns or garden foliage. These diluted solutions contain chemicals such as pesticides, fungicides, herbicides and fertilizers. Typically, sprayers of this type are attached to a garden hose, and the pressure of the water delivered to the hose is used to create a vacuum that causes a chemical solution in the sprayer to be aspirated into the water in order to provide a diluted solution that is subsequently sprayed. Sprayers of this type include a venturi chamber in which water from the garden hose is mixed with undiluted chemical solution from the sprayer's chemical solution container. In principle, as water passes through the venturi chamber, a syphoning or vacuum action is created by virtue of the velocity of the water passing through the chamber, to draw chemical from the container and into the venturi chamber for dilution with water from the garden hose. Many garden sprayers of this type have a fixed dilution ratio, although some sprayers allow for multiple dilution ratios but are typically of more complex construction, more expensive, and more difficult to use.

Besides their complexity, another drawback of many conventional dispensing systems is that the dilution of the concentrated chemical is inaccurate, resulting in a cleaning product having either too high or too low of a concentration. Many systems have no way of controlling and checking the dilution, so that inaccurate mixing by the janitorial personnel often occurs. Using too much concentrated liquid cleaner is wasteful, unnecessary, and expensive. Over-use of these products also hampers thorough rinsing and leaves messy residues. On the other hand, utilization of too little cleaning concentrate results in a use solution that will not clean adequately.

The present invention solves these and many other problems associated with currently available dispensing systems.

SUMMARY OF THE INVENTION

The present invention is a diluting and dispensing apparatus for concentrated liquid chemicals. A dispensing device such as a gun means is used in the diluting and dispensing apparatus for proportioning and dispensing a chemical. The dispensing device comprises a removable proportioning means such as an aspirator assembly, a locking means for attaching and detaching the proportioning means so that it locks and aligns in a predetermined position, and a first sealing means disposed on the proportioning means which is biased to cover a channel in the proportioning means when it is removed from the dispensing device. The first sealing means prevents leakage of a concentrate chemical once the proportioning means is removed from the dispensing device. The dispensing device can be used to dispense water when the proportioning means has been removed. The dispensing device proportionally mixes a concentrated chemical with water. The proportioning means can be removed and replaced onto the dispensing device quickly without special tools and without disturbing or disconnecting the primary fluid stream plumbing. The present invention also optimizes the primary fluid flow given the metered fluid quantity by providing maximum throat size and primary flow for the required concentration. The present invention combines in a single component the aspirator throat and the metering orifice. This feature allows a single component to be inserted into a gun means that will provide the maximum primary flow with the desired metering orifice size.

In a first embodiment of the dispensing device of the invention, the proportioning means is an aspirator assembly which is inserted into a gun means, with the aspirator assembly having a throat and metering orifice. The aspirator assembly is inserted into the water line of the dispensing device and is readily removable without removing inlet/outlet tubing and piping. In a second embodiment of the dispensing device of the invention, the proportioning means is an aspirator located in a removable front portion of a gun means, which is removably attached to a rear gun portion. In both embodiments, the aspirator can be dedicated to a particular concentrate and is configured to provide the optimum concentrate to water ratio and flow.

In an application where there are several different concentrates, a separate aspirator can be used for each concentrate. Each aspirator is connected by tubing to each concentrate reservoir. The tubing conducts concentrate from the reservoir to the aspirator. A single gun means provides water flow for the several aspirators. The benefit of this arrangement is that each concentrate has a dedicated aspirator that is configured to provide optimum dilution and flow. The present invention provides a convenient means to modify a dispensing system in the field to maximize performance and can be used in virtually any dilution system.

The present invention solves the problem inherent in a fixed configuration aspirator in which the use solution flow and concentration cannot be optimized for each concentrate. Further, prior devices do not allow the gun to be detached from the aspirator for use as a water spray gun such as in the present invention. The present invention can be used in cleaning and sanitizing applications in hotels, schools, nursing homes, office buildings, hospitals, etc. The present invention allows the aspirator to be tailored for each use solution application to provide the maximum flow for the required concentration. Also, the invention provides that both the concentration and primary flow can be optimized for each use solution application.

According to another aspect of the invention, a method for diluting and dispensing liquid solutions comprises the steps of interconnecting a first concentrate pickup tube to the gun means of the invention via a first proportioning means attached to the pickup tube, with the gun means being in fluid communication with a water supply and having a water control valve disposed therein. An outlet end of the gun means is positioned into a storage container and the water control valve in the gun means is opened to draw a concentrated chemical into the gun means via the pickup tube. The filled storage container can then be transported proximate to a point of usage. The first concentrate pickup tube can then be disconnected from the gun means by removing the first proportioning means, and a second concentrate pickup tube can be connected to the gun means by attaching a second proportioning means which is attached to the second pickup tube.

An advantage of the present invention is that it is economical, resulting in cost savings for the user. Furthermore, the present invention is very easy to use and provides considerable flexibility by allowing the user to mix and dispense several different types of cleaning products. The present invention also is safe for the operator, because it minimizes any contact with the concentrated cleaning product. The dispensing system is also advantageous in that it is able to deliver the cleaning and sanitation products in exact use concentrations.

One aspect of the present invention is a dispensing device having a removable proportioning means. Another aspect of the invention is a dispensing apparatus for diluting a concentrated chemical which uses the above dispensing device. A further aspect of the invention is a method of diluting a concentrated chemical by using the above dispensing apparatus. For a better understanding of the invention, and of the advantages obtained by its use, reference should be made to the accompanying drawings and description, in which there is illustrated and described a preferred embodiment of the invention.

BRIEF DESCRIPTION OF THE DRAWING

In the drawings, which form a part of the instant specification and are to be read therewith, a preferred embodiment of the invention is shown, and in the various views, like numerals are employed to indicate like parts.

FIG. 12 is a perspective view of a rack for use with the apparatus illustrated in FIGS. 4–6.

FIG. 13 is a perspective view of the rack illustrated in FIG. 12 with the product containers and gun means mounted therein.

DETAILED DESCRIPTION OF THE INVENTION

Figure 1:
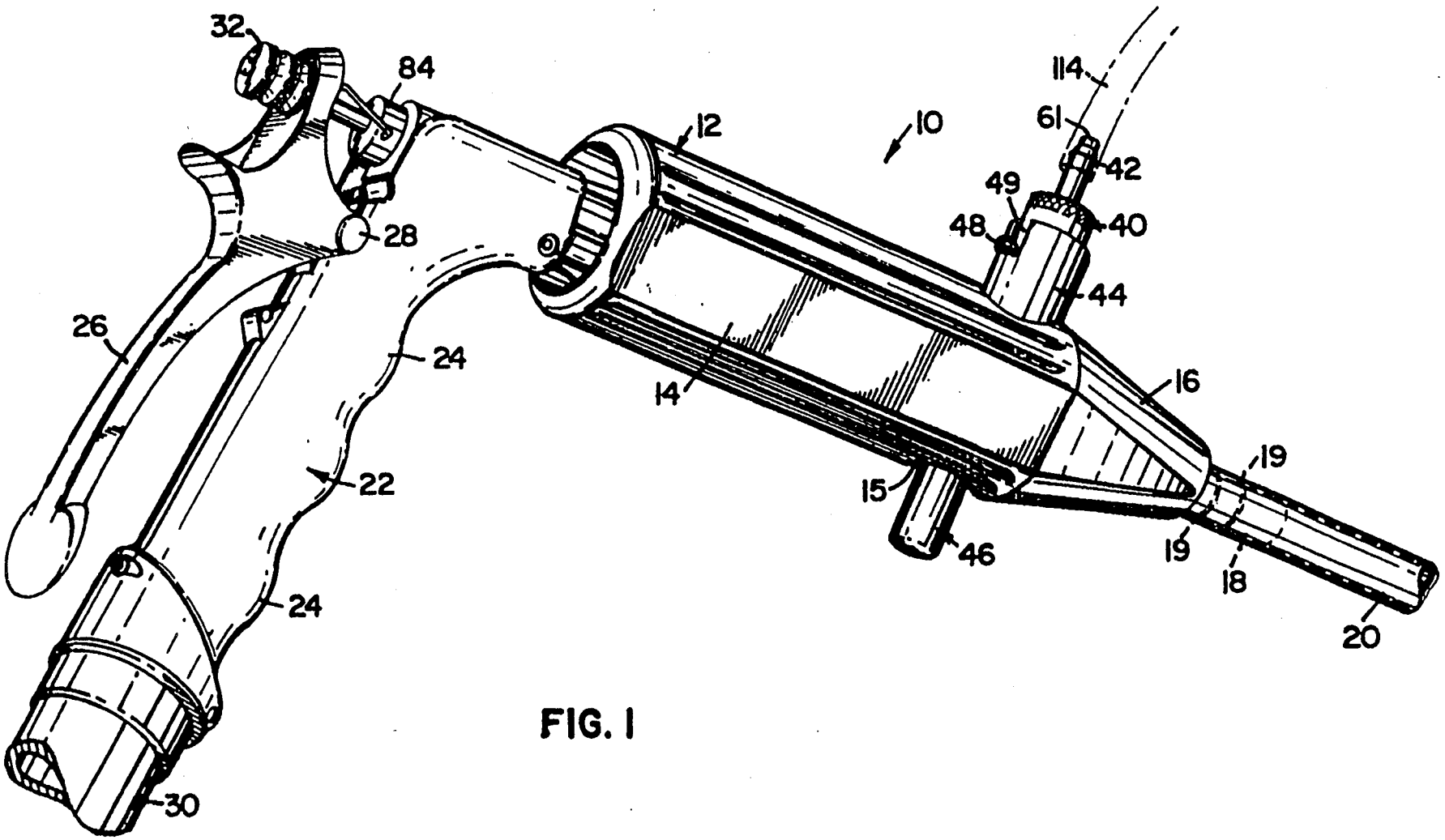
FIG. 1 is a perspective view of a first embodiment the dispensing device according to the present invention.
Figure 2:
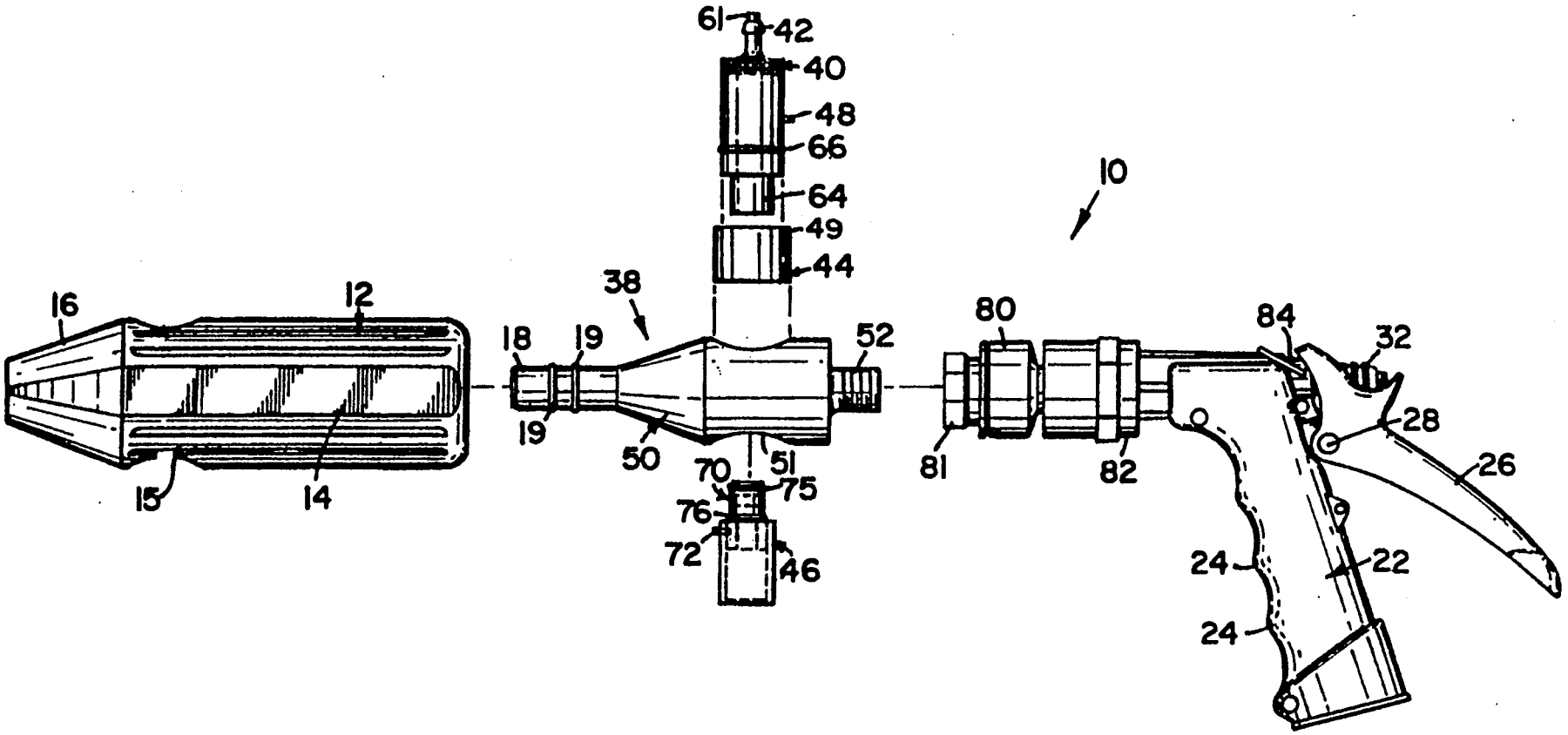
FIG. 2 is a side exploded view of the dispensing device illustrated in FIG. 1.

Referring to FIGS. 1 and 2, a first embodiment is shown of the dispensing device in the form of a gun means 10 for use in the diluting and dispensing apparatus of the invention. The spray gun 10 has a handle 22 and a barrel housing 12. The end of the handle 22 is attached to a water supply conduit 30, and the water enters handle 22 through conduit 30. The end of the handle 22 may be provided with a filter or strainer (not shown) to prevent large particles of foreign matter from entering the spray gun 10. The handle 22 is shaped with contours 24 for the user's fingers. A lever 26 is pivotally connected to handle 22 at pivot pin 28.

As shown in FIG. 2, the spray gun 10 has a water control valve or shut-off valve 82. To initiate water flow, the lever 26 is pivoted toward handle 22 and bears against a cap 32 threaded on the outer end of the valve stem 84, so that by manually pressing on the lever 26, the valve 82 will be removed from its valve seat (not shown) to permit the flow of water. A stop (not shown) of suitable shape may be interposed to prevent the valve from closing, or the operator may hold down the lever 26 during the entire time while dispensing is desired. Various other constructions may also be employed for controlling the water flow through spray gun 10.

The barrel housing 12 of spray gun 10 has a cylindrical portion 14 and a frustoconical portion 16. The outlet end of the frustoconical portion 16 terminates in a rigid outlet tube 20 which is preferably removable from the rest of the spray gun 10. The tube 20 is attached to the spray gun 10 by a friction fit or a bayonet-type connection to nozzle 18 which protrudes from venturi body 50 (see FIG. 2). The nozzle 18 is sized and configured to correspond with the inlet ports 119 on each jug 111 of the dispensing apparatus (see FIG. 5). This attachment to an inlet port 119 is accomplished by means of a frictional fit or other connector mechanism which allows for quick release. Preferably, O rings 19 disposed on nozzle 18 provide for a friction fit between tube 20 and nozzle 18. The outlet tube 20 allows for a flow rate of approximately three to four gallons per minute.

Outlet tube 20 may have various fixtures attached to it to enhance the utility of the dispensing apparatus. A brush may be attached to outlet tube 20 which can be used to scrub with water only or with diluted chemical cleaners. Outlet tube 20 may be in the form of a foaming wand in which air is added to the diluted chemical provided by the spray gun 10. As air mixes with the dispensed chemical a foam is produced. Outlet tube 20 may also have various nozzles attached to its outlet end to provide spraying of diluted chemical in various spray patterns. Alternatively, a restricting orifice (not shown) could be attached to the spray gun 10 to dispense the solution at a higher pressure.

As FIG. 2 shows, disposed within the cylindrical portion 14 of barrel housing 12 is a conduit housing 38, having an extension member 44, a venturi body 50, and a bushing 46 which surrounds a diverter member 70. A removable proportioning means such as aspirator 40 is removably disposed in conduit housing 38 through extension member 44 and into aperture 51. The conduit housing 38 and aspirator 40 are preferably made of a suitable plastic material such as high density polyethylene resistant to corrosive chemicals. Aspirator 40 has a protruding conduit stem 42 which quick connects with a concentrate pickup tube 114 (see FIG. 3). Preferably, aspirator 40 has a pin 48 protruding therefrom and extension member 44 has a slot 49 for insertion of the pin, thereby forming a locking means for locking and aligning aspirator 40 into conduit housing 38 at a predetermined position. The locking means can allow for varying the orientation of the pin slot so that a certain orientation of the slot and pin is necessary for product to flow through the aspirator. Aspirator 40 also preferably has O rings 66, 67 and 68 (see FIG. 3) to provide a friction fit when aspirator 40 is inserted into extension member 44 and aperture 51 of venturi body 50. Both extension member 44 and bushing 46 protrude from opposing ends of an opening 15 in barrel housing 12. Threaded member 52 extends from venturi body 50 and engages with female receiving member 81 when the venturi body 50 is attached to the spray gun 10.

Figure 3:
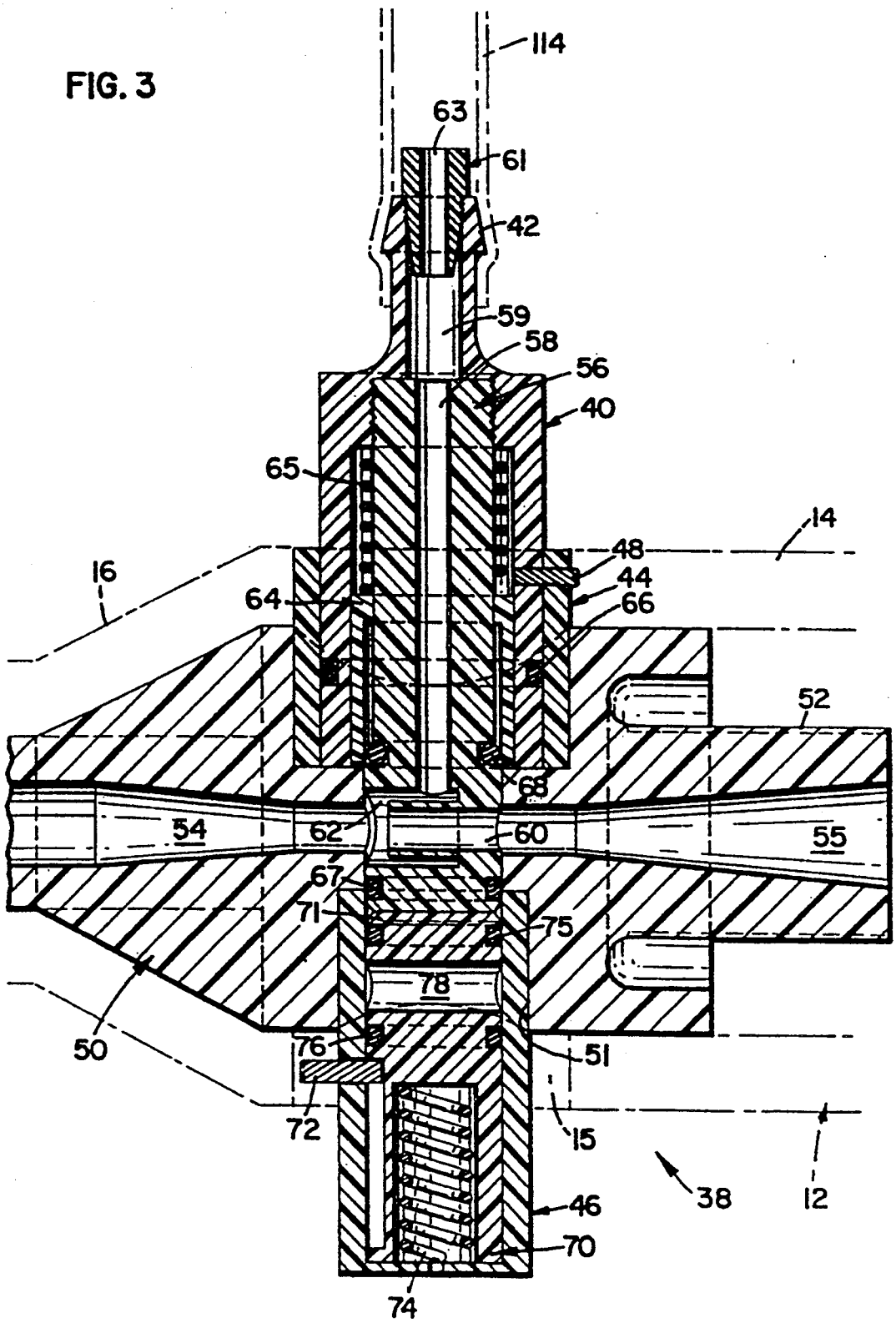
FIG. 3 is an enlarged partial side view in cross-section of the dispensing device illustrated in FIG. 1.

As shown in FIG. 3, the venturi body 50 has channels 54 and 55 extending through it. Conduit stem 42 of aspirator 40 has channel 59 disposed within it and is in fluid communication with metering orifice 58 located within connector portion 56 of aspirator 40. Orifice 58 is in fluid communication with aspirator throat 62. Throat 62 is in fluid communication with channel 60, thereby allowing the concentrate product to be drawn into the spray gun 10 when water flows through channels 54 and 55. In this embodiment, channel 60 is located in aspirator 40 at the opposite end from stem 42. Channels 59, 60 and orifice 58 can vary in diameter based on the dilution rate that is desired. Channel 59 in stem 42 can have a removable metering tip 61 disposed in its inlet end. Metering tip 61 has a channel 63 which can vary in diameter based on the rate of concentrate chemical flow desired.

A first sealing means 64 is disposed on aspirator 40 and is biased to cover channel 60 by spring 65 for preventing leakage of a concentrate chemical once the aspirator 40 is removed from housing 12 of spray gun 10. Preferably, the first sealing means 64 is a sheath which surrounds the lower end of aspirator 40 where channel 60 is located. A second sealing means 71 is located in diverter member 70 for preventing leakage of water from the spray gun 10 through opening 15 and aperture 51 when the aspirator 40 is removed from venturi body 50. O rings 75, 76 are provided on sealing means 71 to provide a friction fit within aperture 51. A passage 78 is located adjacent to the second sealing means 71 and moves into position between channels 54 and 55 by means of spring 74 when aspirator 40 is removed. Pin 72 disposed in bushing 46 limits the movement of sealing means 71 to a predetermined position. Sealing means 71 allows spray gun 10 to be used as a water spray gun to dispense only water when the aspirator 40 has been removed from spray gun 10. The second sealing means 71 is preferably a valve which prevents leakage of water when the spray gun is used to spray water only.

Municipal codes generally require a backflow preventer in systems such as the present invention. The backflow preventer may be remote to the system or incorporated therein. In a preferred embodiment, a backflow preventer 80 (see FIG. 2) is disposed within housing 12 and backflow preventer 80 mounts completely within the spray gun 10. The backflow preventer 80 may be an atmospheric vacuum breaker or a dual check valve with intermediate vacuum breaker and relief vent. A vacuum breaker prevents flow of concentrated chemical into the water hose 30 if a sudden drop in the hose water pressure should occur. In the absence of the vacuum breaker, transitory forces caused by aspiration, siphoning, etc., can draw some of the liquid concentrate back through the hose 30 where it might pollute the water supply.

Figure 4:
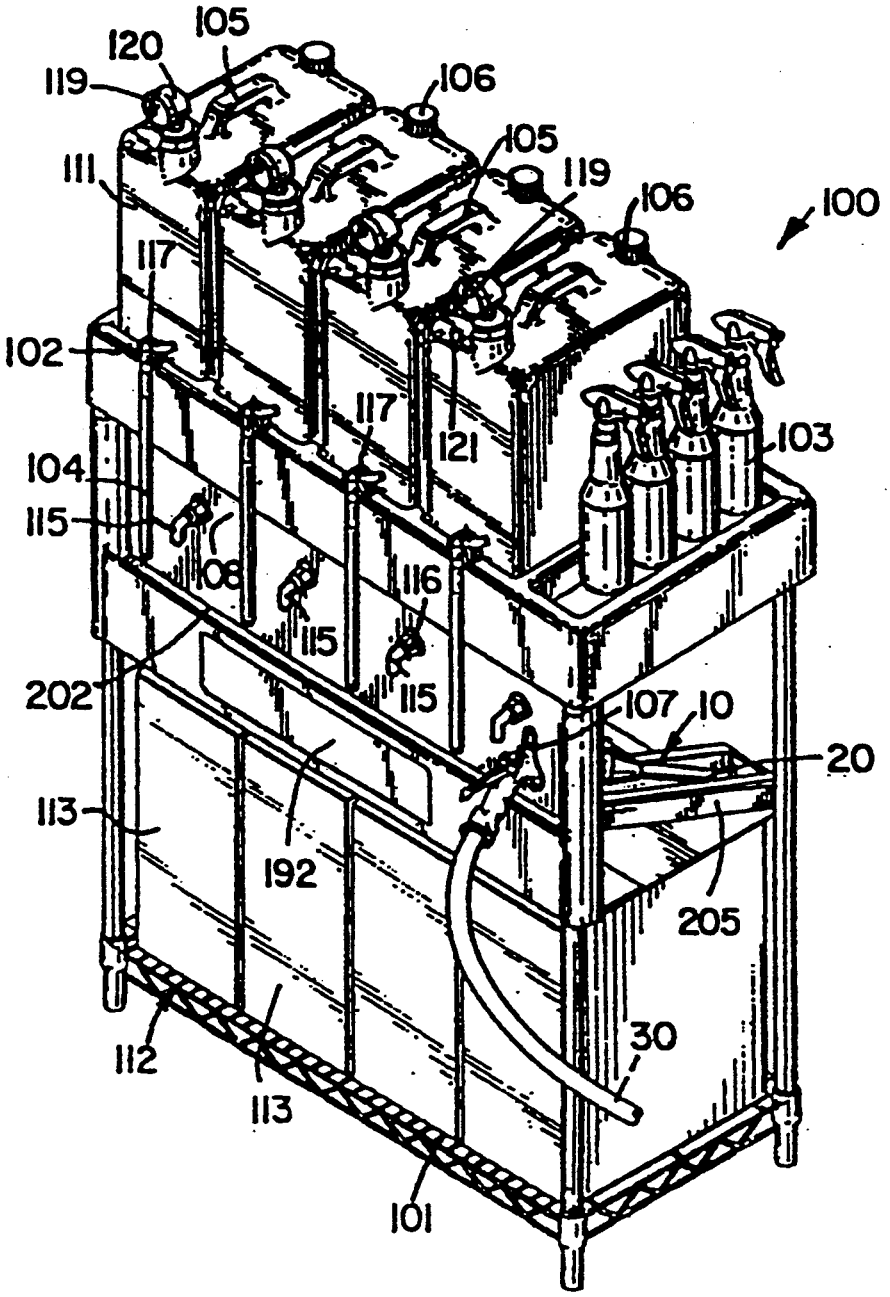
FIG. 4 is a perspective view of the diluting and dispensing system of the present invention.
Figure 5:
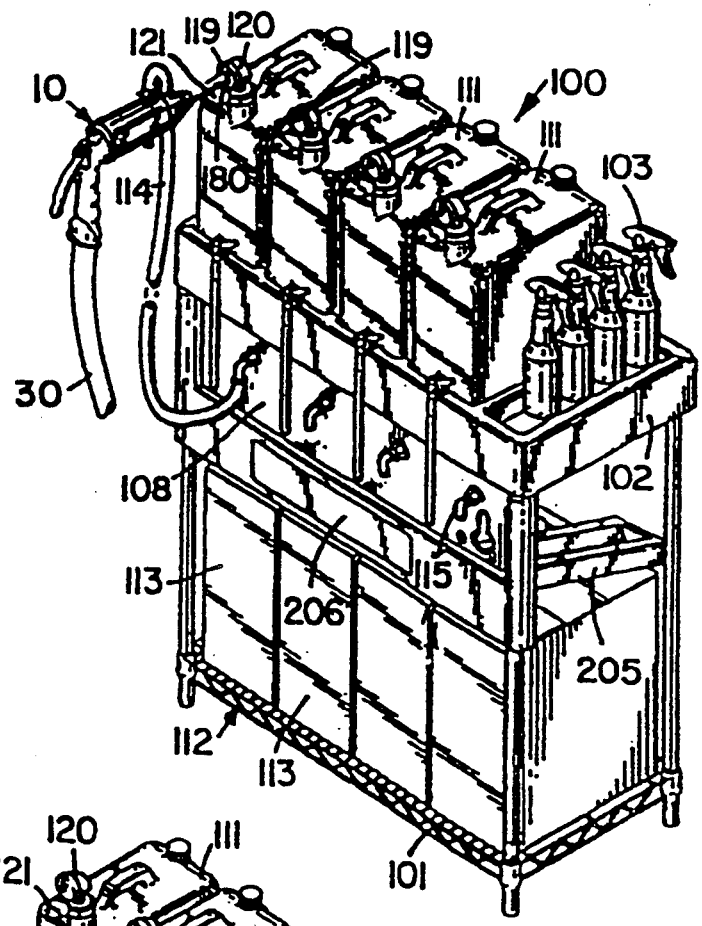
FIG. 5 is a perspective view of the system shown in FIG. 4, with the dispensing gun means in position for the filling of relatively compact jugs.
Figure 6:
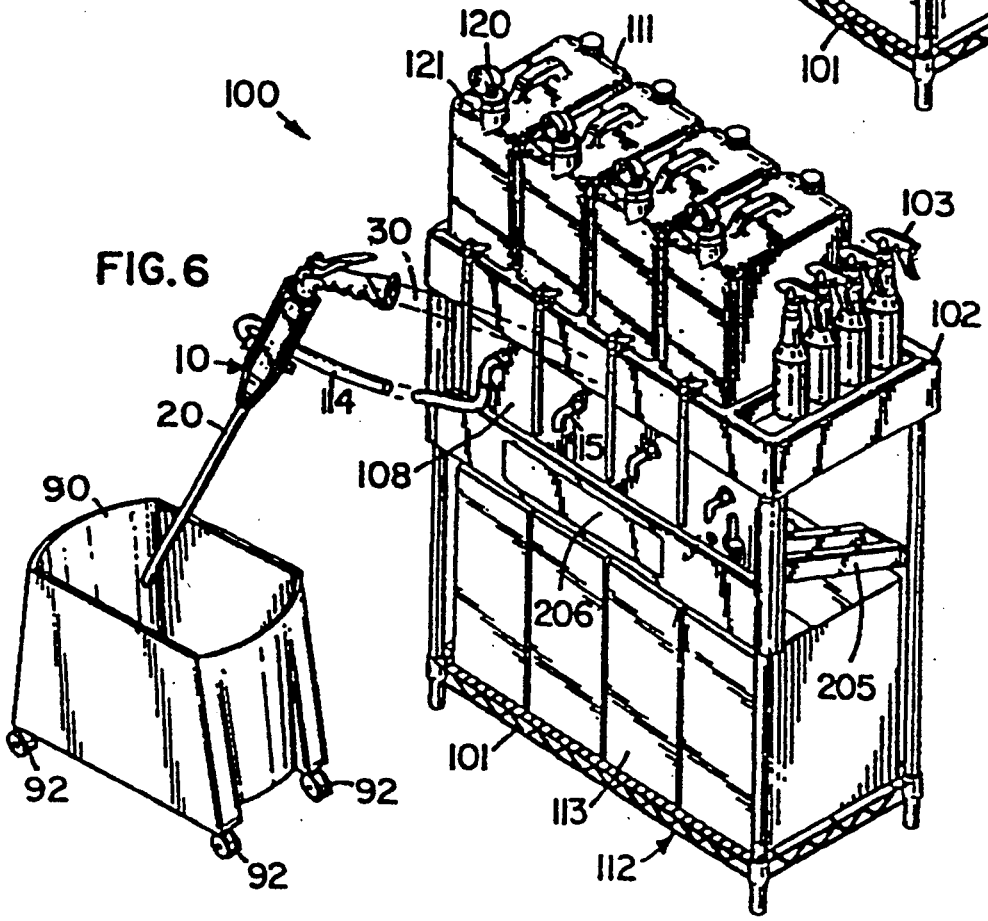
FIG. 6 is a perspective view of the system illustrated in FIG. 4, with the dispensing gun means in position to fill a relatively large container.

FIGS. 4–7 illustrate a diluting and dispensing system 100 which utilizes the spray gun 10 described above. The spray gun 10 is attached to a water supply hose 30 which is interconnected to a suitable water source (not shown). The spray gun 10 is illustrated in FIG. 4 as being in its stored position in which the spray gun 10 hangs within a holster, which is preferably a sloped trough 205 positioned behind an aperture 107 formed within the front panel 108. As shown in FIGS. 5 and 6, a product pickup tube 114 is in fluid communication with spray gun 10.

There are one or more concentrate containers 113 which are preferably mounted upon the bottom shelf 101 of the rack 112. The rack 112 also has a top shelf 102, upon which are supported a plurality of jugs 111 and spray bottles 103. The rack's front panel 108 has a plurality of apertures 116 for passage of the various pickup tubes 114, and has a drip tray 202. In the preferred embodiment, the pickup tubes 114 are substantially hidden from view by the rack's front panel 108.

The containers 111, 103 are suitable for storage of the diluted cleaning product. Each jug 111 has an upper handle 105, a cap 106, and a spigot 117. Preferably, the cap 106 has an umbrella check valve for venting of air from the jug 111. Those skilled in the art will recognize that other structures, such as a porous membrane, could also be used to perform this function. An optional outlet tube 104 may be attached to the spigot 117. The tube 104 is sized and configured to correspond to the height of the spray bottle 103, so that the bottom of the tube 104 extends to the bottom of the spray bottle 103 to minimize foaming when the spray bottle 103 is filled from the contents of the lug 111.

Concentrate containers or concentrate packaging 113 are illustrated in FIGS. 4–6, 11 and 13. The concentrate packaging 113 may be either collapsible and contained within a rigid box, or may themselves have rigid walls. In the preferred embodiment, the container 113 is approximately 12 inches by 12 inches by 6 inches. Each product use container 113 has a pickup tube 114 which extends into the bottom of the container 113. The front panel 108 holds tubes 114 for easy identification and convenience. The lower end of each pickup tube 114 has a check valve (not shown) within the product container 113, such as an umbrella check valve.

The product concentrate may be contained within a collapsible, bladder type package which is held within a rigid container 113, such as those shown in FIGS. 4–6. Preferably, each concentrate package is approximately 2.5 gallons in volume. The cart 112 may be sized and configured to accommodate a plurality of concentrate containers 113, as illustrated in FIGS. 4–6. When utilizing a flexible bladder bag, the pickup tube 114 may be simply attached to an aperture in the bladder bag by means of a threaded connection (not shown). A cap covers the bag's opening when it is not in use. With this design, the concentrate packaging collapses as the concentrate is withdrawn therefrom. The packages are made of any flexible material which is compatible with the chemical concentrate, such as high density polyethylene. Alternatively, a rigid container could hold the concentrate, and the end of the pickup tube 114 could be provided with a suitable pickup probe and foot valve.

The diluting and dispensing apparatus 100 has the ability to fill either relatively compact containers 111, as illustrated in FIG. 5 or relatively large containers such as mop bucket 90, as illustrated in FIG. 6. When a jug 111 is being filled, the outlet tube 20 is removed from the spray gun 10, and the spray gun's nozzle 18 is interconnected to an inlet port 119 of the jug 111. In the preferred embodiment, this is accomplished by means of a friction fit between nozzle 18 and the inlet port 119. For other applications, the spray gun 10 and outlet tube 20 may be positioned within a mop bucket 90 or other relatively large container for the dispensing of the diluted solution, as shown in FIG. 6.

The jug's inlet port 119 is formed within an entrance port cylindrical member 120 proximate the upper surface of the jug 111. The cylindrical member 120 has a downward slope for drainage of solution into the jug 111. The cylindrical member 120 has a hinged cap 121 which is closed when the spray gun 10 is not attached thereto, although the caps 121 are illustrated in the open position in FIGS. 4–6 for purposes of illustration.

Another feature of the present invention is the use of identification means on the corresponding components of the apparatus 100. Preferably, the labels on the concentrate packaging 113, the aperture in the front panel 108, the aspirator 40, the storage jugs 111, and the spray bottles 103 are all color-coded and/or have corresponding labels. This enables a user to quickly and easily attach the appropriate aspirator to the correct concentrate container. This minimizes the chance of contamination and minimizes the likelihood that a particular cleaning product will be used at an improper dilution ratio, thus enhancing the effectiveness of the cleaning product. This feature also results in a cost savings for the user, in that waste of the cleaning product is eliminated when the proper dilution ratio is maintained.

Preferably, each concentrate container 113 has its own aspirator 40 which can be attached and removed from the spray gun 10 as needed. Thus, the spray gun 10 can be easily changed from diluting and dispensing a first concentrate to a different concentrate by simply changing the aspirator 40 in the spray gun 10.

The upper end of each pickup tube 114 preferably terminates in a quick-connect mechanism for attaching tube 114 to stem 42 of aspirator 40 and preferably has an integrated position activated or quick disconnect valve (not shown). In this manner, the pickup tube 114 is completely closed by having a valve at each end. This allows the pickup tube 114 to be disconnected from stem 42 without spillage of any solution. Preferably, the product pickup tube 114 is about one-quarter of an inch in inside diameter and is less than approximately ten feet in length. These dimensions allow for adequate aspirator efficiency, and a larger tube diameter would allow for a longer pickup tube 114 to be utilized. A minimum flow pressure of approximately 20 psi should be provided by the water source.

The aspirator 40 located in spray gun 10 creates a vacuum by the flow of water through the gun which is utilized to withdraw the proper proportion of concentrated cleaning solution from the container 113 and through the corresponding pickup tube 114. In this manner, the water and chemical concentrate enter channel 60 in aspirator 40 simultaneously. The mixed water and concentrate pass through channel 54 and nozzle 18 of the venturi body 50 and fill the product use container 111 or bucket 90. The bucket 90 as illustrated in FIG. 6 has wheels 92 to facilitate transporting the bucket to the point of usage. Dispensing of the diluted solution is at a rate of approximately three to four gallons per minute, and the bucket is filled in approximately one to two minutes.

Examples of the types of concentrated cleaning solutions which may be utilized with the diluting and dispensing apparatus of the invention are: multi-purpose cleaners, e.g. for walls, windows, tile and hard surfaces; germicidal detergents for disinfecting and sanitizing; floor care products; and specialty products for special cleaning needs. However, it is to be understood that the present invention is not to be limited for use only with cleaning products, but can be utilized to store and dispense any type of solution.

The blend ratio, or proportion of chemical to water, is set by the diameter of the orifice 58 in aspirator 40 of spray gun 10. Preferably, the orifice 58 is cylindrical in shape, with the orifice internal diameter being governed by the desired flow rate. The metering orifice diameter may be as small as approximately 0.01 inch, with larger diameters corresponding to higher flow rates. The chemical to water ratio for janitorial applications typically has a range of about 0.25–15%, with the ratio depending upon the size of the orifice 58, the viscosity of the chemical concentrate, and the water pressure. Different dilution ratios are sometimes needed for different applications, e.g., one application might require a 1% solution, whereas another application may require a 10% solution of the same product.

Figure 7:
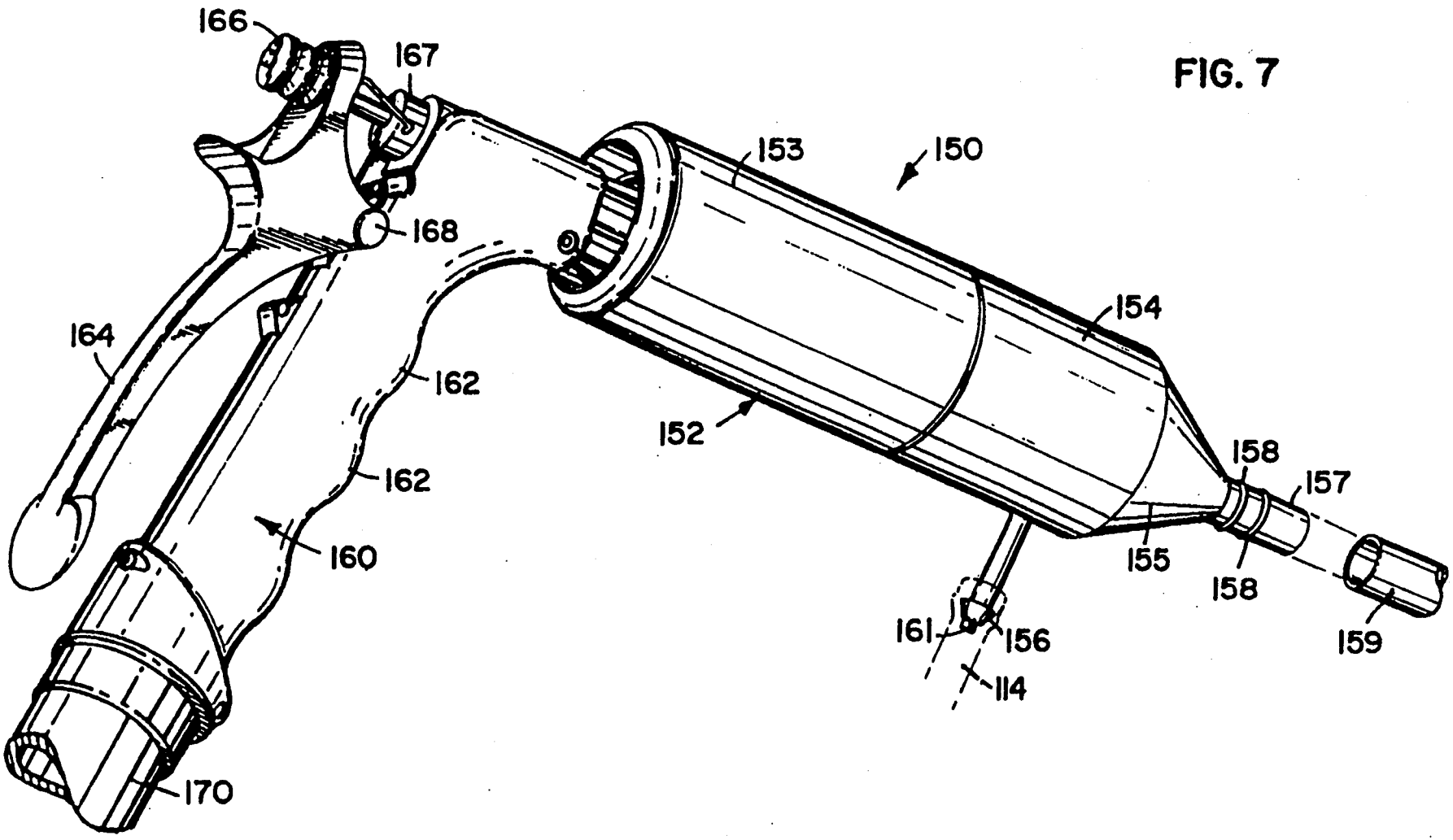
FIG. 7 is a perspective view of a second embodiment of the dispensing device according to the present invention.
Figure 8:
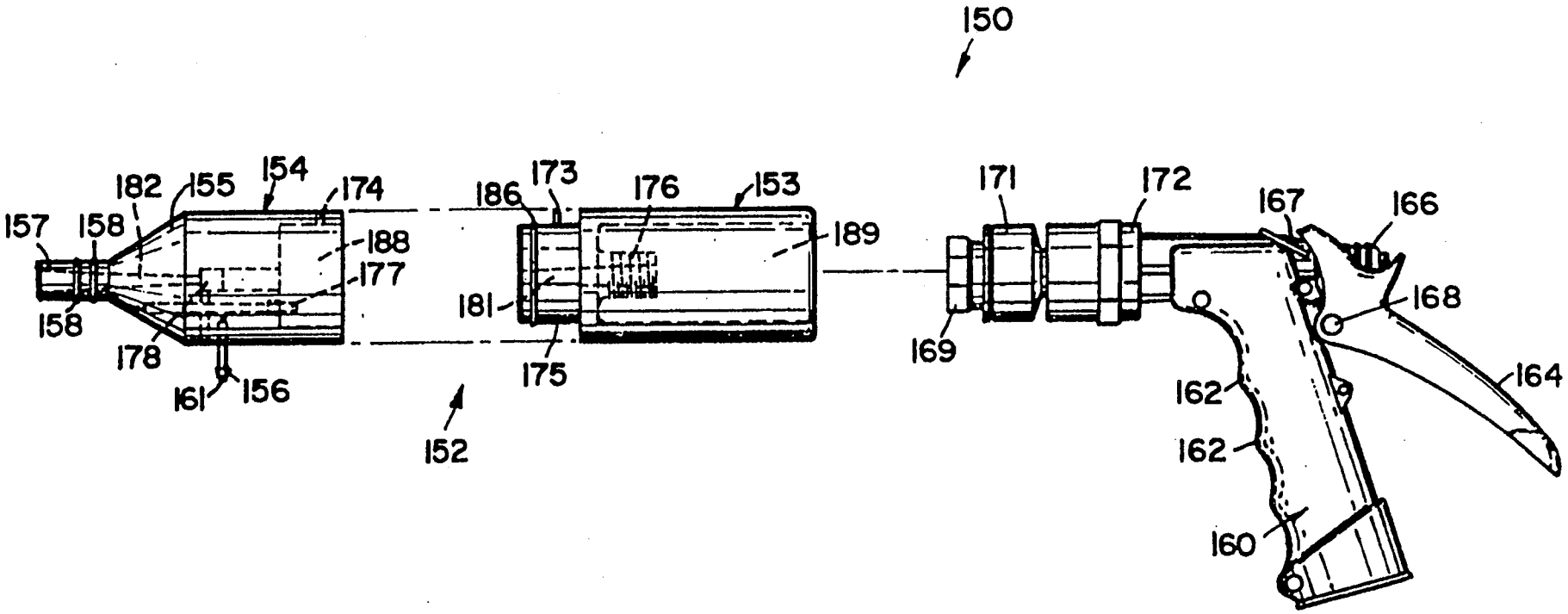
FIG. 8 is a side exploded view of the dispensing device illustrated in FIG. 7.
Figure 9:
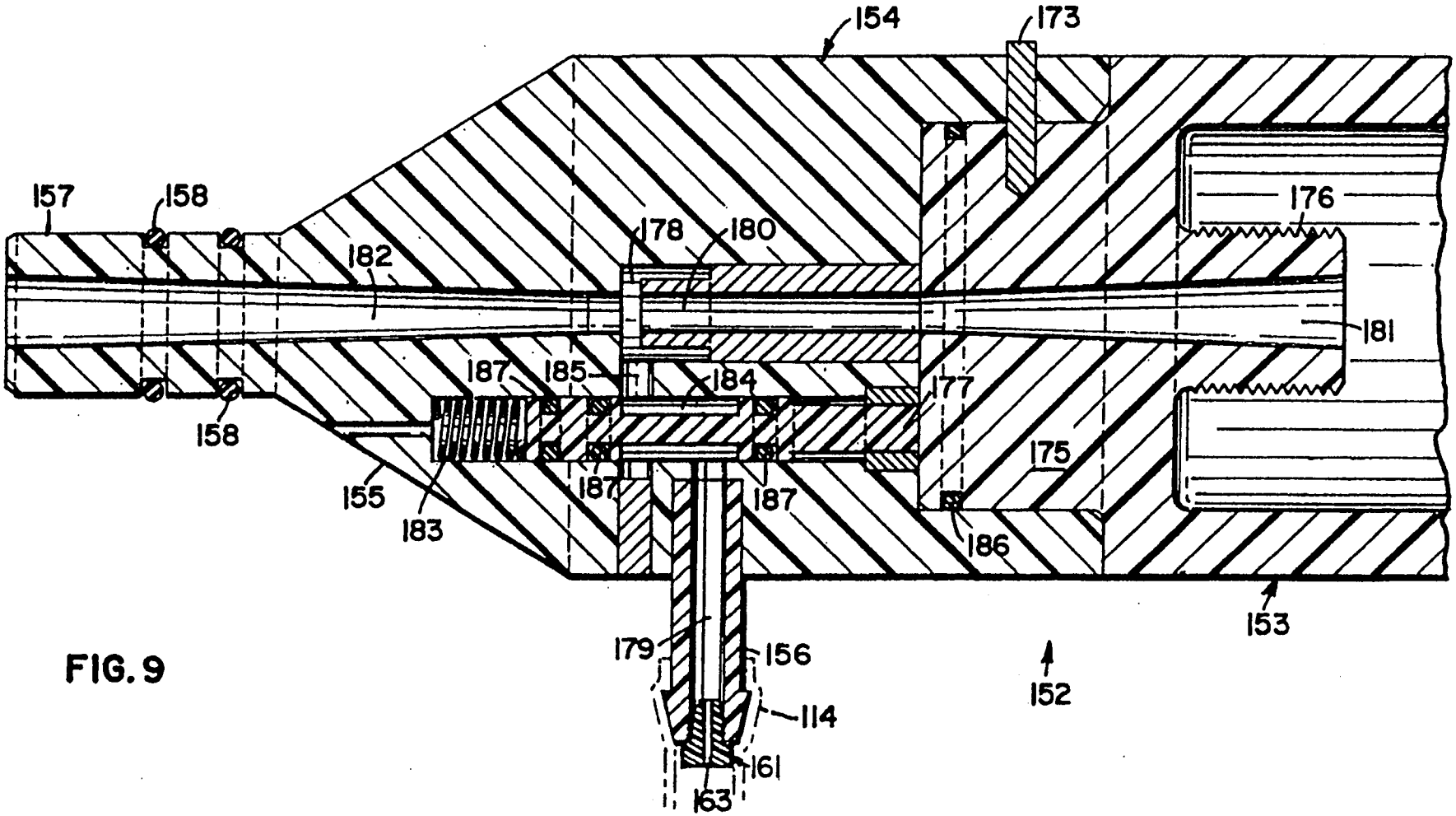
FIG. 9 is an enlarged partial side view in cross-section of the dispensing device illustrated in FIG. 7.

A second embodiment of the dispensing device is shown in FIGS. 7–9 in the form of spray gun 150 for use in the diluting and dispensing apparatus 100 of the invention. The spray gun 150 has a handle 160 and a barrel housing 152. The end of the handle 160 is attached to a water supply hose 170, which is interconnected to a suitable water source (not shown). The end of the handle 160 may be provided with a filter or strainer (not shown) to prevent large particles of foreign matter from entering spray gun 150. The handle 160 is shaped with contours 162 for the user's fingers. A lever 164 is pivotally connected to handle 160 at pivot pin 168. The spray gun 150 has a rigid outlet tube 159, which is preferably removable from nozzle 157. Outlet tube 159 may be provided with various accessories such as a brush attachment or spray nozzle, and may be in the form of a foaming wand, as described above for outlet tube 20 of spray gun 10.

As shown in FIG. 8, the spray gun 150 has a water control valve or shut-off valve 172 like the valve 82 on spray gun 10 described above. To initiate water flow, the lever 164 is pivoted toward handle 160 and bears against a cap 166 threaded on the outer end of the valve stem 167, so that by manually pressing on the lever 164, the valve 172 will be removed from its valve seat (not shown) to permit the flow of water. A stop (not shown) of suitable shape may be interposed to prevent the valve from closing, or the operator may hold down the lever 164 during the entire time while dispensing is desired. A backflow preventer 171 is disposed in the spray gun 150 adjacent to valve 172. The backflow preventer 171 may be an atmospheric vacuum breaker or a dual check valve with intermediate vacuum breaker and relief vent.

Barrel housing 152 of spray gun 150 includes a cylindrical gun portion 153, and a proportioning means such as removable aspirator portion 154 which includes a frustoconical portion 155 terminating in nozzle outlet 157. Barrel housing 152 is preferably made of a suitable plastic material such as high density polyethylene resistant to corrosive chemicals. The outlet tube 159 is attached to the spray gun assembly 150 by a friction fit or a bayonet-type connection to nozzle 157. Preferably, O rings 158 are disposed on nozzle 157 to provide for a friction fit between tube 159 and nozzle 157. Aspirator portion 154 has a protruding conduit stem 156 which quick connects with a concentrate pickup tube 114.

Gun portion 153 has an extension member 175 that fits into an aperture 188 when aspirator portion 154 is attached to gun portion 153. An O ring 186 is disposed on extension member 175 to provide a friction fit when the aspirator portion 154 is attached thereto. Preferably, gun portion 153 has a pin 173 protruding from extension member 175, and aspirator portion 154 has a slot 174 for insertion of pin 173, thereby forming a locking means for locking and aligning the aspirator portion 154 onto gun portion 153 at a predetermined position. Threaded member 176 extends into aperture 189 of gun portion 153 and engages with female receiving member 169 when gun portion 153 is attached to the spray gun 150.

As shown in FIG. 9, the barrel housing 152 has fluid communicating channels 180, 181 and 182 extending through it. Preferably, the channels 181 and 182 widen at approximately a ten degree included angle and are on both ends of channel 180. A concentrate product metering orifice 179 located within stem 156 is in fluid communication with aspirator throat 178 via channels 184 and 185 thereby allowing the concentrate product to be drawn into the spray gun when water flows through channels 180, 181, and 182. Metering tip 161 may be disposed in the inlet end of orifice 179 in stem 156. Metering tip 161 has a channel 163 which may vary in diameter based on the desired flow rate of concentrate chemical.

A sealing means such as shutoff valve member 177 is disposed in channel 184 of aspirator portion 154 and is biased by spring 183 to seal orifice 179 from fluid communication with channel 185 for preventing leakage of chemical from the aspirator portion 154 when it is removed from gun portion 153. Preferably, O rings 187 are disposed on valve member 177 to prevent any leakage of chemical. Spray gun 150 may be used as a water spray gun to dispense only water when the aspirator portion 154 has been removed from gun portion 153.

In operation of the dispensing system of the invention using spray gun 150, the user attaches the desired product pickup tube 114 to stem 156 of spray gun 150 by means of quick-release connectors (not shown). If dispensing into a large container such as a mop bucket is desired, the rigid delivery tube 159 is attached to the spray gun 150 and directed into the mop bucket. Water flow is initiated by opening of the water control valve 172. The concentrate and water pass through the aspirator portion 154 and the rate of concentrate flow is controlled by the diameter size of orifice 179 which can be varied. When the container has been filled to a desired level, the container can be moved to a remote location.

In order to fill the jugs 111, the delivery tube 159 is removed and the nozzle tip 157 is inserted into the jug's inlet port 119, and water flow is initiated as described above. When the jug 111 has been filled to a desired level, the water valve 172 is closed, and the jug 111 may be moved to a remote location. The jug 111 may also be utilized to fill spray bottles 103.

Preferably, each concentrate container 113 has its own aspirator portion 154 which can be attached and removed from the spray gun 150 as needed. Thus, the spray gun 150 can be easily changed from diluting and dispensing a first concentrate to a different concentrate by simply changing the aspirator portion 154 attached to the spray gun.

Chemical resistant materials are preferably used to make the aspirators and spray guns of the invention, such as polyvinyl chloride (PVC), ultra high molecular weight polyethylene, etc.

Figure 10:
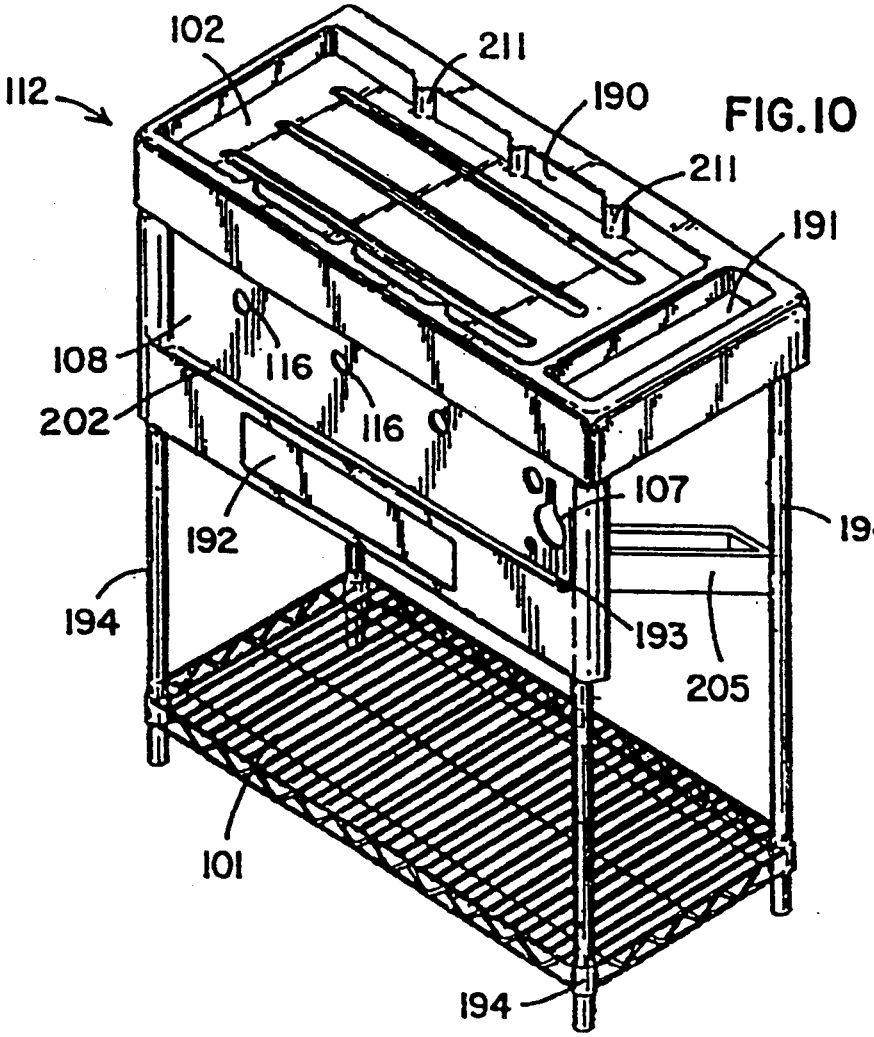
FIG. 10 is a perspective view of the cart utilized with the apparatus illustrated in FIGS. 4—6.

FIG. 10 illustrates a preferred embodiment of the rack 112 for use in the invention. Preferably, the rack 112 is compact in size, i.e., approximately thirty inches in length and fourteen inches wide. In the preferred embodiment, the rack's shelves and front panel are made from vacuum-formed plastic. The rack 112 has an upper shelf 102, bottom shelf 101, and front panel 108. The cart 112 is supported by four legs 194. The upper shelf 102 has recessed portions which may be utilized for supporting the jugs 111, with contoured side walls 190 and notches 211 for stable positioning of the jugs 111. In addition, the upper shelf 102 may be provided with a recessed portion 191 which may accommodate spray bottles or other items.

The front panel 108 has a plurality of apertures 116 for the product pickup tubes 114 and a holster aperture 107 for the spray gun. The holster 205 is sized and configured to accommodate the spray gun barrel and outlet tube if used. In addition, the front panel 108 contains a portion for attachment of a suitable label 192. The front panel 108 also contains a horizontal drip tray portion 202 for catching any drips which may occur when spray bottles are filled from the jugs 111.

Figure 11:
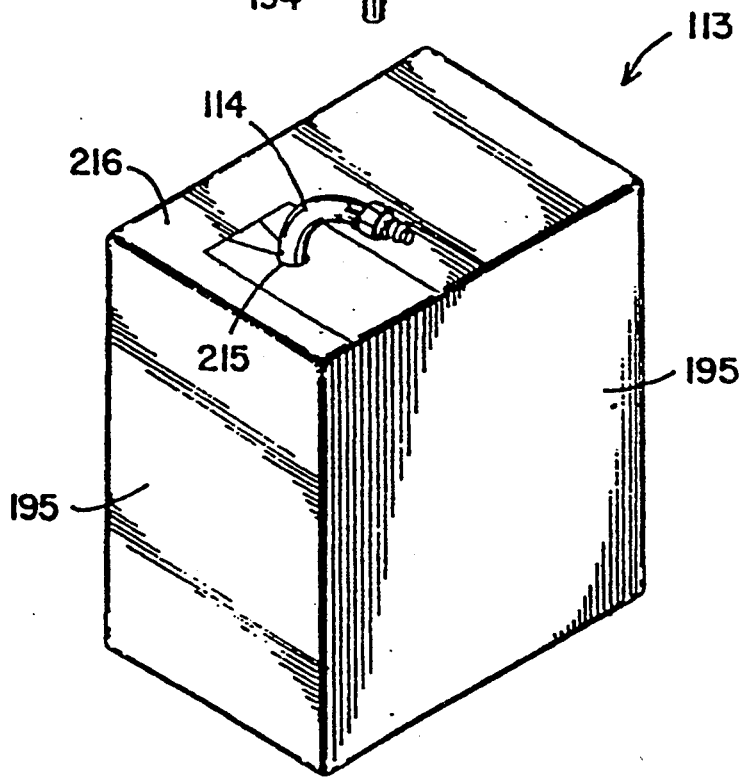
FIG. 11 is a perspective view of the product use container used in the apparatus illustrated in FIGS. 4–6.

FIG. 11 illustrates a concentrated solution's container 113. The container 113 has rigid walls 195, within which is the concentrated solution. The concentrated solution may be held within a flexible bladder bag (not shown) inside the container 113. An aperture 215 in the top wall 216 of the container 113 permits passage of the pickup tube 114. Alternatively, the container 113 may have an aperture and fitting in a side wall near the bottom (not shown). With this design, the pickup tube 114 extends up the side of the container 113.

FIGS. 12 and 13 illustrate a portable rack 196 which may be utilized with the present invention. The rack 196 is sized and configured to accommodate two of the concentrate storage containers 113. The rack 196 includes rings 197 which serve as a holder for the spray gun. Preferably, there is also a drip cup 216 on the rack 196. The rack 196 is preferably made of wire and has a plurality of parallel members 198 which form a support floor for the containers 113. The rack 196 may have outwardly protruding members 217 which provide clearance between the rack 196 and container 113 in the event the pickup tube 114 extends up the outside of the container 113 as described above. The rack 196 also has hooks 199 for mounting of the rack 196 upon a wall, if desired. The rack 196 may be provided with wheels (not shown) to facilitate portability.

The rack 196 is suitable for situations in which the user is to fill relatively large containers such as mop buckets. The rack 196 allows the user to transport the dispensing system near the point of usage, at which point the water supply hose may be connected to the nearest faucet or other water supply mechanism. The rack 196 preferably supports the containers 113 slightly above floor level by support members 200 to keep the containers 113 dry.

An advantage of the present invention is that it results in cost savings for the user. Because the system is simpler in design, its cost is lower than conventional dispensers. In addition, the dispensing system needs only a single water line and backflow preventer which further reduces the cost of installation. Whereas conventional dispensing systems are quite complex and expensive, the simplicity of the present invention enables it to be low in cost and affordable for even small housekeeping and food service operations. The present invention operates on water power alone, and does not require electrical connections. The various fittings, tubes, and valves are readily accessible and can be repaired easily by any necessary tightening, repair, or replacement measures.

Furthermore, the proportioning system of the present invention is very easy to use. The user can fill either large containers, such as mop buckets, or small containers, such as five gallon jugs, by positioning the spray gun proximate the desired storage container. The filling of the container is a one-handed operation, since the user need only depress the spray gun's water activation lever so as to activate water flow and dispense the use solution. In contrast, prior art systems are typically two-handed operations, with one hand on the water control device and the other hand controlling the output hose.

The present invention also provides considerable flexibility by allowing the user to mix and dispense several different types of cleaning products. The invention can be used for any number of chemical solutions, because the system is completely modular. The supply lines for the various concentrated cleaning products can be connected and disconnected easily, and only a single water line is needed. The modular aspect of the present invention allows the system to be appropriate for a user who has only a single concentrated product to be diluted, as well as multiple products. With the prior art systems, the number of cleaning compositions which could be dispensed is limited to the number of water lines or to a predetermined number of control valves provided in the dispenser. In contrast, the present invention can be utilized with an unlimited number of products by simply providing additional removable aspirator assemblies.

Another advantageous feature of the present invention is that it is economical. Only a single aspirator, backflow preventer and valve assembly are required, regardless of the number of different concentrated products. This feature allows a cost savings by greatly simplifying and reducing the plumbing requirements. The present invention also is safe for the operator, because it minimizes any contact with the concentrated cleaning product.

The dispensing apparatus is also advantageous in that it is able to deliver the cleaning and sanitation products in exact use concentrations. The metering devices contained within the removable aspirators assure that the proper dilution ratio is set, thereby obviating the tendency of some janitorial personnel to over-use the product. The use concentrations can be controlled to the precise number of ounces per gallon or parts per million required. This accurate dispensing eliminates product over-use, waste and spilling.

Yet another feature of the apparatus of the invention is that it is portable enough to be set up in various locations. Because the sizes of the various components are relatively small, because only a single water line is needed, and because the system is modular, it can be set up close to the point of usage, thereby saving time and effort for the janitorial personnel. The quick connect water assembly requires no plumbing hook-up, and can be used at any sink or faucet.

Even though numerous characteristics and advantages of the invention have been set forth in the foregoing description, together with the details of the structure and function of the invention, the disclosure is illustrative only, and changes may be made in detail, especially in matters of shape, size, and arrangement of parts, within the principles of the invention, to the full extent indicated by the broad, general meaning of the appended claims.

What is claimed is:

1. A dispensing device for proportioning and dispensing a liquid chemical diluted with a liquid solvent, comprising:

(a) a removable aspirator means for aspirating a liquid chemical into a liquid solvent and being contained within an aspirator housing, said aspirator housing being removable from a remainder of said dispensing device, said aspirator means being operatively interconnected to a conduit for a concentrated liquid chemical and to a conduit for a liquid solvent;

(b) a locking means for attaching and detaching said aspirator mean so as to interconnect said aspirator means within said dispensing device;

(c) a sealing means disposed on said aspirator means, said sealing means being biased to cover a channel in said aspirator means when said aspirator means is removed from said dispensing device; and (d) at least one concentrate container containing a concentrated chemical, with one end of a concentrate pickup tube extending into said concentrate container and the other end connected to said aspirator means.

2. The dispensing device of claim 1, further including means for permitting said dispensing device to be used as a water spray gun to dispense water when said proportioning means has been removed from said dispensing device.

3. A dispensing device for proportioning and dispensing a chemical, comprising:

a) a are movable proportioning means being contained within a barrel housing;

b) a locking means for attaching and detaching said proportioning means so that said proportioning means locks and aligns in a predetermined position within said dispensing device;

c) a first sealing means disposed on said proportioning means, said first sealing means biased to cover a channel in said proportioning means when said proportioning means is removed from said dispensing device; and d) a second sealing means biased to cover an opening in said barrel housing when said proportioning means is removed therefrom.

4. A dispensing device for proportioning and dispensing a chemical, comprising:

a) a removable proportioning means;

b) a locking means for attaching and detaching said proportioning means so that said proportioning means locks and aligns in a predetermined position within said dispensing device; and c) a first sealing means disposed on said proportioning means, said first sealing means biased to cover a channel in said proportioning means when said proportioning means is removed from said dispensing device, and wherein said first sealing means comprises a sheath which is spring biased into a closed position covering said channel when said proportioning means has been removed from said dispensing device.

5. A dispensing device for proportioning and dispensing a chemical, comprising:

a) a removable proportioning means, wherein said proportioning means is an aspirator;

b) a locking means for attaching and detaching said proportioning means so that said proportioning means locks and aligns in a predetermined position within said dispensing device; and c) a first sealing means disposed on said proportioning means, said first sealing means biased to cover a channel in said proportioning means when said proportioning means is removed from said dispensing device.

6. An apparatus for diluting and dispensing a chemical, comprising:

(a) a delivery means attached to and in fluid communication with a diluent supply hose which carries a diluent, said delivery means comprising:

(i) a removable aspirator means for aspirating a chemical into said diluent;

(ii) a locking means for attaching and detaching said aspirator means so that said aspirator means locks and aligns in a predetermined position within said delivery means; and (iii) a first sealing means disposed on said aspirator means, said first sealing means biased to cover a channel in said aspirator means when said aspirator means is removed from said delivery means; and (b) at least one concentrate container containing a concentrated chemical, with one end of a concentrate pickup tube extending into said concentrate container and the other end connected to said aspirator means, wherein said concentrate container is supported on a rack.

7. The apparatus of claim 6, further comprising a barrel housing containing said aspirator means.

8. The apparatus of claim 6, further comprising a storage container supported upon said rack, said storage container having an inlet port.

9. The apparatus of claim 8, wherein said delivery means includes a nozzle sized and configured to correspond to said storage container's inlet port.

10. The apparatus of claim 8, wherein a shelf on said rack includes contoured ridges to conform with the size and configuration of said storage container.

11. The apparatus of claim 8, wherein said rack includes a front panel having a plurality of apertures, each of said apertures corresponding to said concentrate pickup tube and being sized and configured for passage of said concentrate pickup tube therethrough.

12. The apparatus of claim 11, wherein said concentrate container, said front panel of said rack, said aspirator means, and said storage container have corresponding identification means.

13. The apparatus of claim 6, further comprising a backflow preventer in fluid communication with said delivery means.

14. An apparatus for diluting and dispensing a chemical, comprising:

(a) a gun means attached to and in fluid communication with a diluent supply hose which carries a diluent, said gun means comprising:
  (i) a removable proportioning means, wherein said proportioning means is an aspirator;
  (ii) a locking means for attaching and detaching said proportioning means so that said proportioning means locks and aligns in a predetermined position within said gun means; and
  (iii) a first sealing means disposed on said proportioning means, said first sealing means biased to cover a channel in said proportioning means when said proportioning means is removed from said gun means; and (b) at least one concentrate container containing a concentrated chemical, with one end of a concentrate pickup tube extending into said container and the other end connected to said gun means wherein said concentrate container is supported on a rack.

15. An apparatus for diluting and dispensing a chemical, comprising:

(a) a gun means attached to and in fluid communication with a diluent supply hose which carries a diluent, said gun means comprising:
  (i) a removable proportioning means contained with a barrel housing;
  (ii) a locking means for attaching and detaching said proportioning means so that proportioning means locks and aligns in a predetermined position within said gun means;
  (iii) a first sealing means disposed on said proportioning means, said first sealing means biased to cover a channel in said proportioning means when said proportioning means is removed from said gun means;
  (iv) a second sealing means biased to cover an opening in said barrel housing when said proportioning means is removed therefrom; and (b) at least one concentrate container containing a concentrated chemical, with one end of a concentrate pickup tube extending in said concentrate container and the other end connected to said gun means, wherein said concentrate container is supported rack.

16. An apparatus for diluting and dispensing a chemical, comprising:

(a) a gun means attached to and in fluid communication with a diluent supply hose which carries a diluent, said gun means comprising:
  (i) a removable proportioning means;
  (ii) a locking means for attaching said proportioning means so that said proportioning means locks and aligns in a predetermined position within said gun means; and
  (iii) a first sealing means disposed on said proportioning means, said first sealing means biased to cover a channel in said proportioning means when said proportioning means is removed from said gun means, wherein said first sealing means comprises a sheath which is spring biased into a closed position covering said channel when said proportioning means has been removed from said gun means; and (b) at least one concentrate container containing a concentrated chemical, with one end concentrate pickup tube extending into said concentrate container and the other end connected to said gun means, wherein said concentrate container is supported on a rack.

17. The apparatus of claim 16, wherein said gun means has a rigid outlet tube attached thereto.

18. The apparatus of claim 17, wherein said rigid outlet tube is removable from said gun means.

19. The apparatus of claim 17, wherein said outlet tube includes an attachment selected from the group consisting of a brush attachment, a spray nozzle, and a foaming means.

20. An apparatus for diluting and dispensing a chemical, comprising:

(a) a gun means attached to and in fluid communication with a diluent supply hose which carries a diluent, said gun means comprising:
  (i) a removable proportioning means;
  (ii) a locking means for attaching and detaching said proportioning means so that said proportioning means locks and aligns in a predetermined position within said gun means; and
  (iii) a first sealing means disposed on said proportioning means, said first sealing means biased to cover a channel in said proportioning means when said proportioning means is removed from said gun means; and (b) at least one concentrate container containing a concentrated chemical, with one of a concentrate pickup tube extending into said concentrate container and the other end connected to said gun means, wherein said concentrate container is supported on a rack, wherein said rack includes a holster sized and configured to accommodate said gun means.

21. A system for diluting and dispensing a chemical, comprising:

(a) a plurality of concentrate containers for storing concentrated chemicals, each of said storage containers having a pickup tube extending therefrom, said concentrate storage containers being supported upon a rack;

(b) a gun means having a first water inlet end and a second outlet end, said gun means comprising:
  (i) a barrel housing;
  (ii) a valve for controlling water flow disposed within said housing;

(iii) a removable aspirator disposed in said barrel housing, said aspirator attached to one of said pickup tubes;

(iv) a locking means for attaching and detaching said aspirator so that it locks and aligns in a predetermined position in said gun means;

(v) a first sealing means disposed on said aspirator, said first sealing means biased to cover a channel in said aspirator when said aspirator is removed from said gun means; and (vi) a nozzle with a removable rigid outlet tube attached thereto;

wherein said gun means is mountable upon said rack and said pickup tubes each have an aspirator attached thereto; and (c) at least one storage container for storing a diluted chemical, said outlet tube being insertable within said storage container for dispensing of said diluted chemical.

22. The system of claim 21, further comprising a second sealing means biased to cover an opening in said barrel housing when said aspirator is removed therefrom.

23. The system of claim 21 wherein said first sealing means comprises a sheath which is spring biased into a closed position covering said channel when said aspirator has been removed from said gun means.

24. The system of claim 21, further comprising a plurality of jugs for storing a diluted chemical, each of said jugs having an inlet port sized and configured to correspond to said nozzle of said gun means for dispensing of said diluted chemical, said jugs being supported upon said rack while said diluted chemical is being dispensed therein.

25. The system of claim 24, wherein a shelf of said rack includes contoured ridges to conform with the size and configuration of said jugs.

26. The system of claim 24, wherein said rack includes a front panel having a plurality of apertures, each of said apertures corresponding to one of said pickup tubes and being sized and configured for passage of said pickup tubes therethrough.

27. The system of claim 26, wherein said concentrate containers, said front panel, said aspirator, and said jugs have corresponding identification means.

28. The system of claim 21, wherein said rack includes a holster sized and configured to accommodate said gun means.

29. A system for diluting and dispensing a chemical, comprising:

(a) a plurality of concentrate containers for storing concentrated chemicals, each of said storage containers having a pickup tube extending therefrom, said concentrate storage containers being supported upon a rack;

(b) a gun means having a first water inlet end and a second outlet end, said gun means comprising:

(i) a barrel housing;

(ii) a valve for controlling water flow disposed within said housing;

(iii) a removable aspirator disposed in said barrel housing, said aspirator attached to one of said pickup tubes;

(iv) a locking means for attaching and detaching said aspirator so that it locks and aligns in a predetermined position in said gun means;

(v) a first sealing means disposed on said aspirator, said first sealing means biased to cover a channel in said aspirator when said aspirator is removed from said gun means; and (vi) a nozzle with a removable rigid outlet tube attached thereto; wherein said outlet tube includes an attachment selected from the group consisting of a brush attachment, a spray nozzle, and a foaming means;

wherein said gun means is mountable upon said rack and said pickup tubes each have an aspirator attached thereto; and (c) at least one storage container for storing a diluted chemical, said outlet tube being insertable within said storage container for dispensing of said diluted chemical.

30. A method for diluting and dispensing liquid solutions, comprising the steps of:

(a) interconnecting a first concentrate pickup tube to a delivery means, said delivery means comprising:

(i) a first removable aspirator means for aspirating concentrate into a diluent, said aspirator means being attached to said first pickup tube during the interconnecting step;

(ii) a locking means for attaching and detaching said aspirator means so that said aspirator means locks and aligns in a predetermined position within said delivery means; and (iii) a first sealing means disposed on said aspirator means, said first sealing means biased to cover a channel in said aspirator means when said aspirator means is removed from said delivery means;

wherein said delivery means is in fluid communication with a water supply and has a water control valve disposed therein;

(b) positioning an outlet end of said deliver means into a storage container; and (c) opening said water control valve to provide a diluent stream, thereby aspirating concentrated chemical into said diluent stream via said pickup tube with said aspirating means.

31. The method of claim 30, further comprising the steps of disconnecting said first concentrate pickup tube from said delivery means by removing said first aspirator means, and connecting a second concentrate pickup tube to said delivery means by attaching a second aspirator means to said deliver means, said second aspirator means being attached to said second pickup tube.

32. The method of claim 30, further comprising the step of transporting said storage container proximate a point of usage.

* * * * *

UNITED STATES PATENT AND TRADEMARK OFFICE
CERTIFICATE OF CORRECTION

PATENT NO. : 5,344,074

DATED : September 6, 1994

INVENTOR(S) : John R. Spriggs et al.

It is certified that error appears in the above-identified patent and that said Letters Patent is hereby corrected as shown below:

On the title page, under the "Related U.S. Application Data" heading, please delete "abandoned" and substitute therefore --now U.S. Patent No. 5,259,557 issued November 9, 1993.--

On column 4, line 57, please delete "DRAWING" and substitute therefore --DRAWINGS--

On column 4, line 63, please insert --of-- after the word "embodiment"

On column 7, line 62, please delete "lug" and substitute therefore --jug--

On column 8, line 11, please delete "cart" and substitute therefore --rack--

On column 11, line 41, please delete "cart" and substitute therefore --rack--

On column 13, line 51 (claim 1), please delete "mean" and substitute therefore --means--

On column 14, line 1 (claim 3), please delete "are movable" and substitute therefore --removable--

On column 15, line 41 (claim 14), please insert --concentrate-- after the word "said"

On column 15, line 65 (claim 15), please delete "in" and substitute therefore --into--

UNITED STATES PATENT AND TRADEMARK OFFICE

CERTIFICATE OF CORRECTION

PATENT NO. : 5,344,074

DATED : September 6, 1994

INVENTOR(S) : John R. Spriggs et al.

It is certified that error appears in the above-identified patent and that said Letters Patent is hereby corrected as shown below:

On column 15, line 68 please insert --on a-- after the word "supported"

On column 16, line 21 please insert --of a-- after the word "end"

On column 16, line 50 please insert --end-- after the word "one"

On column 18, line 47 please insert --a-- after the word "aspirating"

On column 18, line 55 please delete "deliver" and substitute therefore --delivery--

Signed and Sealed this

Seventeenth Day of January, 1995

*Attest:*

*Attesting Officer*

Bruce Lehman

BRUCE LEHMAN

*Commissioner of Patents and Trademarks*